US009603474B2

(12) United States Patent
Hill

(10) Patent No.: US 9,603,474 B2
(45) Date of Patent: Mar. 28, 2017

(54) CUP HOLDER WITH A HANDLE

(71) Applicant: Margaret E. Hill, West Palm Beach, FL (US)

(72) Inventor: Margaret E. Hill, West Palm Beach, FL (US)

(73) Assignee: Margaret E Hill, West Palm Beach, FL (US)

( * ) Notice: Subject to any disclaimer, the term of this patent is extended or adjusted under 35 U.S.C. 154(b) by 25 days.

(21) Appl. No.: 14/503,681

(22) Filed: Oct. 1, 2014

(65) Prior Publication Data

US 2016/0095456 A1 Apr. 7, 2016

(51) Int. Cl.
*A47G 23/02* (2006.01)

(52) U.S. Cl.
CPC ..... *A47G 23/0216* (2013.01)

(58) Field of Classification Search
USPC ..... 220/737, 738, 741, 742
See application file for complete search history.

(56) References Cited

U.S. PATENT DOCUMENTS 3,104,788 A * 9/1963 Wood ..... A47G 23/0208 211/74
4,685,583 A * 8/1987 Noon ..... A47G 23/0216 220/710.5
5,868,310 A * 2/1999 Leszczynski ..... B65D 25/2814 220/738
6,557,751 B2 * 5/2003 Puerini ..... A47G 23/0216 220/738
7,080,753 B1 * 7/2006 Miller ..... A47G 23/0216 220/666
7,918,364 B2 * 4/2011 Kim ..... B65D 81/3876 220/737
2002/0185496 A1 * 12/2002 Puerini ..... A47G 23/0216 220/738
2005/0001126 A1 * 1/2005 Breeze-Stringfellow ..... A47G 23/0216 248/311.2
2012/0043243 A1 * 2/2012 Selina ..... B65D 81/3876 206/459.5

* cited by examiner

*Primary Examiner* — Anthony Stashick
*Assistant Examiner* — Madison L Poos

(57) ABSTRACT

A beverage cup holder with a handle constructed from a thin, elongated strip of material. The general shape can be described as having: tabs that extend from the strip along the top and bottom portions of the longitudinal edges to serve as securing flaps; and one cutout on either end of the strip provide an open space that can be utilized as a handle. The strip is wrapped around a cup and joined at the tabs, which are folded down and secured. The cup holder with a handle that is subsequently formed can be placed around a cup with a close fit, and held by the handle. These products are easy to hold. The handle is such that it separates the cup from direct contact with the user, leaving the user unaffected by the temperature, and provides a clear view of printed decoration.

15 Claims, 2 Drawing Sheets

FIG. 1
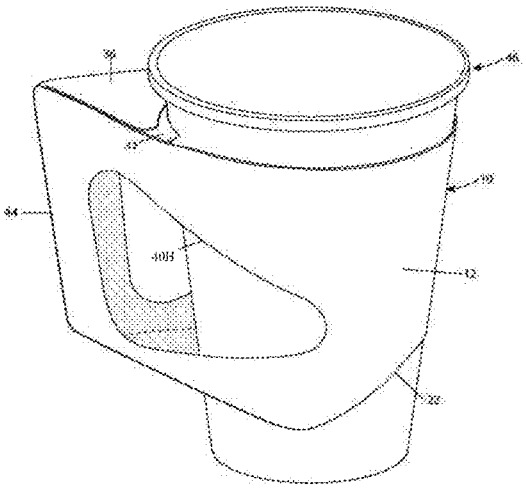
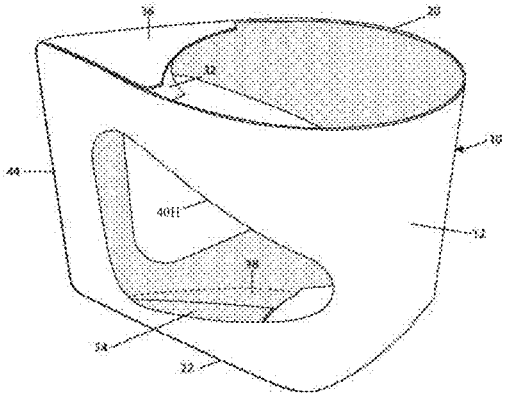
FIG. 3
FIG. 2
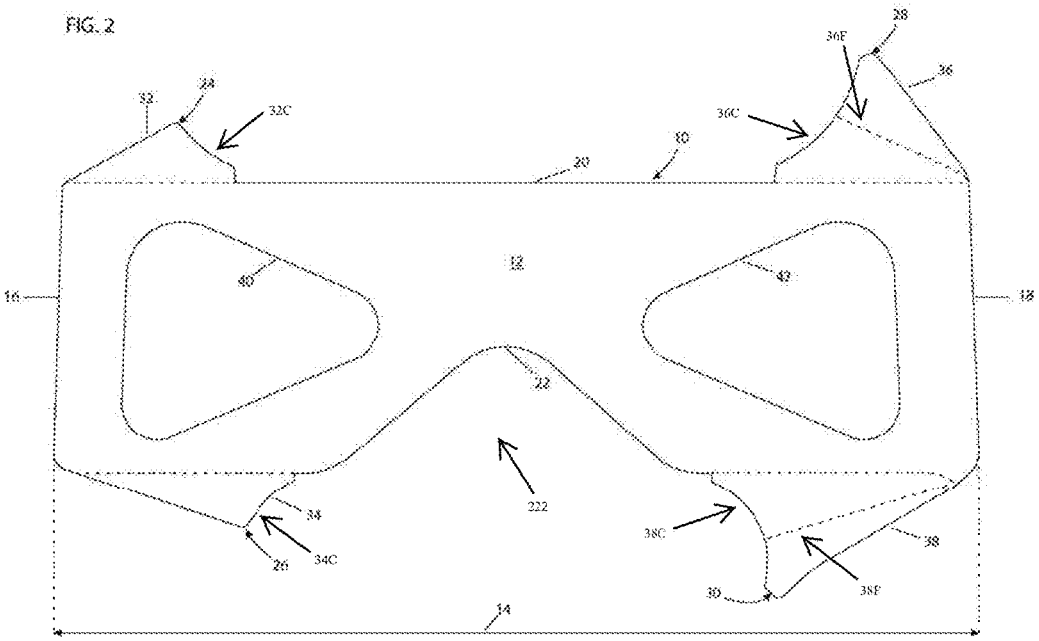

FIG. 4
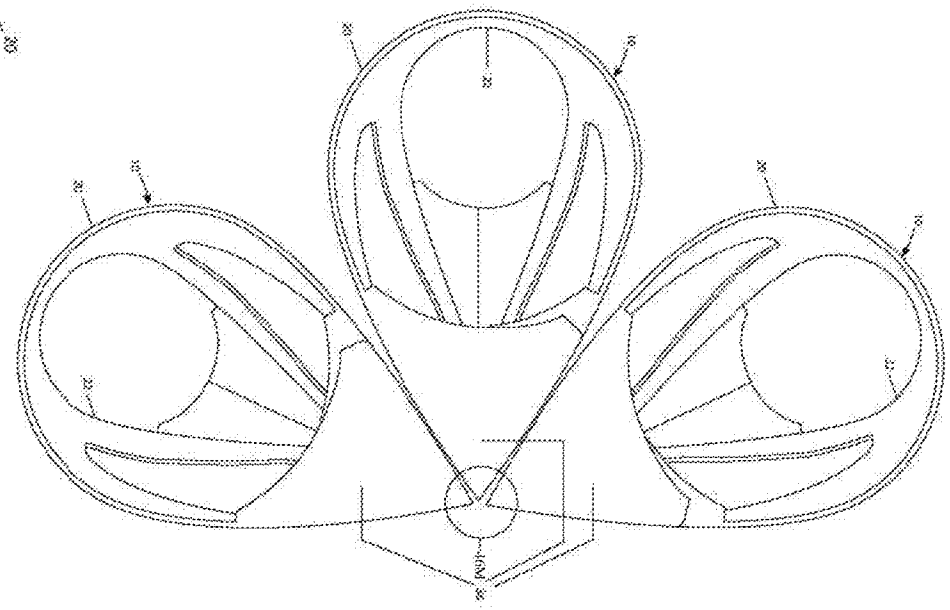
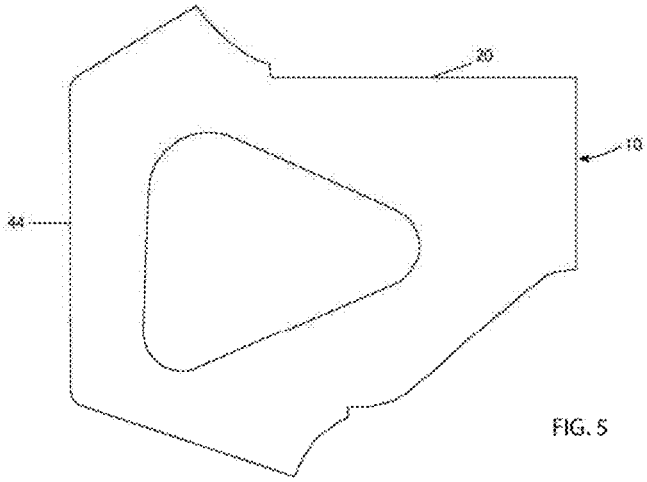
FIG. 5

CUP HOLDER WITH A HANDLE

BACKGROUND OF THE INVENTION

Cup holders for hot and cold beverages have thus far been fabricated by an annular ring of thin material that is wrapped around a cup. Both ends are then secured to construct a beverage sleeve. This sleeve provides a layer of insulation between the outer surface of the cup wall, and the hand of the user. Such a shape is shown in U.S. Pat. No. 5,425,497, hereby incorporated by reference.

Often, the insulation presented by the traditional cup holder is not sufficient to form a protective barrier between the user and the temperature of the beverage, which can be either hot or cold. This is because the cup holder does not have a handle.

An attempt to resolve the issue stated above is shown in U.S. Pat. No. 4,685,583, hereby incorporated by reference, which noted the inclusion of a handle onto a cup holder. The disposable beverage cup handle of U.S. Pat. No. 4,685,583 makes claims based on a differing design and purpose.

Additional examples of United State Patents granted to such inventions include those issued to: Munkachy U.S. Pat. No. 2,936,068; Herrmann U.S. Pat. No. 2,965,281; Leszczynski U.S. Pat. No. 5,868,310; and Miura U.S. Pat. No. D449961.

In addition to the problem of beverage temperature, disposable cup holders limit the quantity of beverages that can be carried in one hand. In this manner, the traditional cup holder restricts the user to carry only one cup per hand. The U.S. Pat. No. 3,104,788, hereby incorporated by reference, was an attempt to permit the carrying of two cups in one hand.

The manner in which a user is forced to carry a cup when using a cup holder obstructs the visibility of decoration that may appear on the surface, making it so that its communication value is greatly diminished.

BRIEF SUMMARY OF THE INVENTION

This invention relates generally to a means for facilitating the carrying of cups for beverages and other liquids. In particular, the invention relates to a collapsible cup holder with a handle that can be used in conjunction with cups composed from paper, plastic, Styrofoam, or other materials. The handle makes the cup easier to grip, adds protection against the temperature of the beverage, allows a greater carrying capacity in one hand, as well as provides visibility for printed decoration.

BRIEF DESCRIPTION OF THE SEVERAL VIEWS OF THE DRAWING

FIG. 1 is a perspective view of an assembled cup holder with a handle, in one embodiment of the present invention, shown in combination with a cup.

FIG. 2 is a top plan view of the present design of the cup holder with a handle, shown unassembled.

FIG. 3 is a side view of the cup holder with a handle.

FIG. 4 is a top perspective of three cup holders with a handle, placed side by side.

FIG. 5 is a side view of the flattened cup holder with a handle.

DETAILED DESCRIPTION OF THE INVENTION

Referring to FIG. 1, the cup holder with a handle 10 is shown in combination with a cup 46. Cup holder with a handle 10 is shown in an assembled state in FIG. 1.

Referring to FIG. 2, the cup holder with a handle 10 is preferably fabricated from an elongated strip 12 of thin material, typically paperboard or plastic.

As illustrated in FIG. 2 the cup holder with a handle 10 can be described as a strip with distal ends. The strip 12 has a length 14 defined by a first end 16 and a second end 18. The length of 14 can be described as greater than the measurement of the first end 16 and the second end 18.

The strip 12 is widest on the first end 16, on the left, from 24 on the top, to 26 on the bottom, and widest on the second end 18, on the right, from 28 on the top to 30 on the bottom. The top of the strip 12 is defined by longitudinal edge 20 and the bottom is defined by longitudinal edge 22. Longitudinal edge 20 is comprised of a tab 32 on the first end 16 and a tab 36 on the second end 18. Longitudinal edge 22 is comprised of tab 34 on the first end 16 and a tab 38 on the second end 18.

The strip 12 can be described as having two triangular shapes cutout from the body. Triangular shape 40 and triangular shape 42 are evenly spaced from each other and placed in position that creates a mirroring form. The base of triangular shape 40 is aligned parallel to first end 16, and the base of triangular shape 42 is aligned parallel to the second end 18. This concludes the unassembled cup holder with a handle illustrated in FIG. 2.

To assemble the cup holder with a handle 10 shown in FIG. 1, strip 12 is bent so that the first end 16 of FIG. 2 meets the second end 18. Tab 36 is then folded and secured on top of tab 32, and tab 38 is folded and secured under tab 34. The resulting form in FIG. 1, and FIG. 3, creates a carrying handle 44 and presents tab 36 visible on the top, and the inner surface of tab 34 and tab 38 visible through the handle opening 40H. The assembled cup holder with a handle 10 of FIG. 2 shows longitudinal edge 20 and longitudinal edge 22 creates a cylindrical opening through which a cup can be inserted. FIG. 1 illustrates longitudinal edge 20 and longitudinal edge 22 conforming to outer parameters of a cup 46. The strip 12 has a triangular cutout 222 near the longitudinal edge 22. The tab 32 has a first concave curved side 32C; the tab 36 has a second concave curved side 36C; the tab 34 has a third concave curved side 34C; and the tab 38 has a fourth concave curved side 38C. The tab 36 has a first folding line 36F near a centroid of the tab 36. The tab 38 has a second folding line 38F near a centroid of the tab 38.

A clearer view of the carrying handle 44 is shown in FIG. 3. The handle 44 presents the opportunity for a human user to carry a cup without handling the cup itself. This improves the gripability of a cup and increases insulation value, allowing for the handling of hot and cold liquids.

As shown in FIG. 4 a human user can hold and carry multiple drinks in one hand. This particular depiction shows three cup holders with a handle being carried side by side, dramatically improving carrying capacity to include the possibility of multiple quantities 46M.

Furthermore, the handle 44 makes it possible for decoration to appear on the surface of strip 12, making it visually appealing to users.

When the cup holder with a handle 10 is not in use, it can be folded flat and kept in storage, as shown in FIG. 5.

The present invention can be viewed as a method of making a cup holder with a handle. The method includes providing a flat sheet of material, forming the flat sheet into an elongated strip 12 having a top longitudinal edge 20 and a bottom longitudinal edge 22. Two triangular shapes 40 and 42, symmetrical in outline, spacing and placement are cutout from the strip 12. Elongate strip 12 is then folded so that tab 32 and tab 36 of longitudinal edge 20, and tab 34 and tab 38 of longitudinal edge 30 are folded and respectively secured. A cup can then be inserted into the cylindrical opening.

Many materials are envisioned for use in making strip 12, however paperboard is preferred. This particular material provides a sturdy structure to handle various volumes of liquid and remain intact. In examples of the present disclosure, the cup holder with the handle 10 is made of a material selected from the group consisting of recyclable, biodegradable and non-biodegradable materials.

The invented cup holder with a handle is applicable in any situation where the gripability, insulation value, carrying capacity or the visibility of decoration on a cup needs to be increased. It is particularly applicable as a cup holder with a handle for use with all beverage cups including coffee cups, soda cups and cups for alcoholic beverages.

The foregoing descriptions of the specific embodiment of the invention are for the purpose of description and illustration. They are not intended to be exhaustive or to limit the invention to the precise form disclosed. Thus, various embodiments are intended to be included within the scope of claims of this invention.

The invention claimed is:

1. A cup holder with a handle comprising:

an elongated strip having a first end, a second end, a top longitudinal edge, a bottom longitudinal edge, a first tab near the first end, a second tab near the second end, a third tab near the first end and a fourth tab near the second end;

wherein the elongated strip is bent to connect the first end to the second end in order to shape a top curved edge and a bottom curved edge to receive a cup through an open cavity; a respective cutout is placed near each of the first and second ends of the elongated strip to form the handle when the elongated strip is fully assembled; the second tab is secured on top of the first tab; the fourth tab is secured under the third tab to support the handle of the cup holder with the handle; and the first tab is parallel to the third tab when the cup holder with the handle is in an assembled condition.

2. A method of using the cup holder with the handle of claim 1, wherein a hand of a user holds a plurality of cup holders.

3. The cup holder with the handle of claim 1, wherein the cup holder with the handle is collapsible.

4. The cup holder with the handle of claim 3, wherein the cup holder with the handle is flattened and stored.

5. The cup holder with the handle of claim 1, wherein the cup holder with the handle turns the cup without a cup handle into a mug.

6. The cup holder with the handle of claim 1, wherein the cup holder with the handle is made of a material selected from the group consisting of recyclable, biodegradable and non-biodegradable materials.

7. A cup holder comprising an elongated strip having a first end, a second end opposite the first end, a top longitudinal edge, a bottom longitudinal edge, a first tab near the first end, a second tab near the second end, the first and second tabs directly connecting and extending away from the top longitudinal edge, a third tab near the first end, a fourth tab near the second end, the third and fourth tabs directly connecting and extending away from the bottom longitudinal edge, a first cutout near the first end and a second cutout near the second end;

wherein the cup holder is characterized by a folded condition in which the elongated strip is folded so that the first end is aligned with the second end and the first cutout is aligned with the second cutout;

an unassembled condition in which the elongated strip is flat; and an assembled condition in which the elongated strip is bent so that the first end meets the second end, the top longitudinal edge becomes a curved top edge, and the bottom longitudinal edge becomes a curved bottom edge;

the second tab is secured on top of the first tab; and the fourth tab is secured under the third tab.

8. The cup holder of claim 7, wherein the cup holder is further characterized by the assembled condition in which the bent elongated strip forms an open cavity.

9. The cup holder of claim 8, wherein the open cavity is of a cylindrical shape.

10. The cup holder of claim 7, wherein the first and second cutouts are of triangular shapes.

11. The cup holder of claim 10, wherein a first base of the triangular shape of the first cutout is parallel to the first end of the elongated strip and a second base of the triangular shape of the second cutout is parallel to the second end of the elongated strip.

12. The cup holder of claim 7, wherein the elongated strip further has a triangular cutout near the bottom longitudinal edge.

13. The cup holder of claim 7, wherein the second tab has a first folding line near a centroid of the second tab and wherein the cup holder is further characterized by the assembled condition in which the second tab is folded along the first folding line.

14. A cup holder comprising an elongated strip having a first end, a second end opposite the first end, a top longitudinal edge, a bottom longitudinal edge, a first tab near the first end, a second tab near the second end, the first and second tabs extending away from the top longitudinal edge, a third tab near the first end, a fourth tab near the second end, the third and fourth tabs extending away from the bottom longitudinal edge, a first cutout near the first end and a second cutout near the second end;

wherein the cup holder is characterized by a folded condition in which the elongated strip is folded so that the first end is aligned with the second end and the first cutout is aligned with the second cutout;

an unassembled condition in which the elongated strip is flat; and an assembled condition in which the elongated strip is bent so that the first end meets the second end, the top longitudinal edge becomes a curved top edge, and the bottom longitudinal edge becomes a curved bottom edge;

the second tab is secured on top of the first tab; and the fourth tab is secured under the third tab; and wherein the first tab has a first concave curved side; the second tab has a second concave curved side; the third tab has a third concave curved side; and the fourth tab has a fourth concave curved side;

wherein the first and second concave curved sides have a first same curvature; and wherein the third and fourth concave curved sides have a second same curvature.

15. The cup holder of claim 14, wherein the cup holder is further characterized by the assembled condition in which a curvature of the curved top edge is equivalent to the first same curvature and a curvature of the curved bottom edge is equivalent to the second same curvature.

* * * * *